US011686157B1

(12) United States Patent
Aros

(10) Patent No.: US 11,686,157 B1
(45) Date of Patent: Jun. 27, 2023

(54) PRESSURE REVERSING VALVE FOR A FLUID-ACTUATED, PERCUSSIVE DRILLING TOOL

(71) Applicant: Jaime Andres Aros, Santiago (CL)

(72) Inventor: Jaime Andres Aros, Santiago (CL)

( * ) Notice: Subject to any disclaimer, the term of this patent is extended or adjusted under 35 U.S.C. 154(b) by 0 days.

(21) Appl. No.: 17/674,305

(22) Filed: Feb. 17, 2022

(51) Int. Cl.
*E21B 6/00* (2006.01)
*E21B 1/26* (2006.01)
*E21B 1/00* (2006.01)
*B25D 9/12* (2006.01)

(52) U.S. Cl.
CPC ..... *E21B 6/00* (2013.01); *E21B 1/00* (2013.01); *E21B 1/26* (2020.05); *B25D 9/12* (2013.01)

(58) Field of Classification Search
CPC ..... E21B 6/00; E21B 1/00; E21B 1/26; B25D 9/12
USPC ..... 173/206; 175/296
See application file for complete search history.

(56) References Cited

U.S. PATENT DOCUMENTS 2,823,013 A * 2/1958 Stenuick ..... E21B 6/00 173/104
2,886,004 A * 5/1959 Morrison ..... E21B 6/00 173/78
3,169,584 A * 2/1965 Stenuick ..... E21B 4/14 173/18
3,387,671 A * 6/1968 Collier ..... E21B 4/14 175/296
3,648,786 A * 3/1972 Chenoweth ..... E21B 21/08 91/47
3,768,576 A * 10/1973 Martini ..... E21B 7/24 173/136
3,876,350 A * 4/1975 Warder ..... F03C 2/304 418/231
3,970,152 A * 7/1976 Harris ..... E21B 4/14 173/15
4,467,867 A * 8/1984 Baker ..... E21B 49/001 166/308.4
5,085,284 A * 2/1992 Fu ..... E21B 4/14 173/78
5,301,761 A * 4/1994 Fu ..... E21B 4/14 175/296
7,921,941 B2 * 4/2011 Aros ..... E21B 4/14 175/212
8,006,776 B1 * 8/2011 Polsky ..... E21B 4/14 173/15
8,631,884 B2 * 1/2014 Lyon ..... E21B 4/14 175/296

(Continued)

OTHER PUBLICATIONS

Subs and Adapters—Sales webpage by N&N Drilling Supply Mfr.—URL https://nndrilling.com/subs-adapters/ (Year: 2023).*

(Continued)

*Primary Examiner* — Valentin Neacsu

(57) ABSTRACT

A pressure reversing valve for a fluid-actuated percussive drilling tool has a front thrust surface in communication with a rear chamber and a rear thrust surface in communication with a pressurized volume isolated from the flow coming from the source of pressurized fluid. The pressurized volume is in communication with a front chamber and allows the valve to take advantage of the imbalanced profile of the pressures inside the front and rear chambers that naturally occurs for enabling an asymmetric feeding process of the rear chamber that is also less sensitive to the bottom hole pressure.

12 Claims, 8 Drawing Sheets

(56) References Cited

U.S. PATENT DOCUMENTS

| | | | | |
|---|---|---|---|---|
| 8,640,794 | B2 * | 2/2014 | Aros | E21B 10/38 175/417 |
| 8,973,681 | B2 * | 3/2015 | Aros | E21B 4/14 175/414 |
| 9,016,403 | B2 * | 4/2015 | Aros | E21B 4/14 175/296 |
| 10,316,586 | B1 * | 6/2019 | Aros | E21B 4/14 |
| 11,174,679 | B2 * | 11/2021 | Bruandet | E21B 10/38 |
| 11,207,769 | B2 * | 12/2021 | Koizumi | B25D 9/26 |
| 2009/0188723 | A1 * | 7/2009 | Aros | E21B 4/14 175/296 |
| 2011/0209919 | A1 * | 9/2011 | Aros | E21B 4/14 175/296 |
| 2011/0297447 | A1 * | 12/2011 | Lyon | E21B 4/14 175/296 |
| 2013/0233626 | A1 * | 9/2013 | Aros | E21B 4/14 175/296 |

OTHER PUBLICATIONS

Drill Subs—Sales webpage by America West Drilling Supply—URL https://americawestdrillingsupply.com/drillsubs2.html (Year: 2023).*

Webpage of Boretek, Company affiliated with Inventor AROS—URL https://www.boretek.net/espanol/Martillos_y_Accesorios.html (Year: 2023).*

* cited by examiner

PRESSURE REVERSING VALVE FOR A FLUID-ACTUATED, PERCUSSIVE DRILLING TOOL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "SEQUENCE LISTING"

Not applicable

BACKGROUND OF THE INVENTION

Field of Application of the Invention

The present invention relates generally to pressurized fluid flow systems for percussive mechanisms operating with said fluid, particularly for percussive drilling tools and more particularly for DTH (Down-The-Hole) hammers, and to DTH hammers with said systems.

State of the Art

DTH Hammers

A numerous variety of percussive drilling mechanisms exist which use a pressurized fluid as the means for transmitting power. Among these are DTH hammers which are widely used in the drilling industry, in mining as well as civil works and the construction of water, oil and geothermal wells. The DTH hammer, of cylindrical shape, is used assembling it on a drill rig located at ground surface. The drill rig also comprises a drill string comprising rods assembled together, the rear end, understood as the end that is farther to the hammer's drill bit (element described further along in these specifications), being assembled to a rotation and thrust head and the front end, understood as the end that is closer to the hammer drill bit, coupled to the hammer. Through this drill string the drill rig supplies the necessary pressurized fluid to the hammer for the hammer to operate.

Parts of the DTH Hammer

The main movable part of the hammer is the piston. This member of the hammer has an overall cylindrical shape and is coaxially and slidably disposed in the inside of a cylindrical outer casing. When the hammer is operative in the mode known as "drilling mode", the piston effects a reciprocating movement due to the change in pressure of the pressurized fluid contained in two main chambers, a front chamber and a rear chamber, formed inside the hammer and located at opposite ends of the piston. The piston has a front end in contact with the front chamber and a rear end in contact with the rear chamber and has outer sliding surfaces or sliding sections of the outer surface of the piston (as opposed to sections with recess areas, grooves or bores) and inner sliding surfaces or sliding sections of the inner surface of the piston, again as opposed to sections with recess areas, grooves or bores. The outer sliding surfaces are mainly designed for ensuring guidance and alignment of the piston within the hammer. Besides, in most hammers these surfaces, together with the inner sliding surfaces of the piston, in cooperation with other elements as described further along in these specifications, permit control of the alternate supply and discharge of pressurized fluid into and from the front and rear chambers.

The frontmost part of the hammer, which performs the drilling function, is known as the drill bit and it is slidably disposed on a driver sub mounted in the front end of the outer casing, the drill bit being in contact with the front chamber and adapted to receive the impact of the front end of the piston.

In order to ensure the correct alignment of the drill bit with respect to the outer casing, a component known as drill bit guide is commonly used, which is disposed in the inside of the outer casing. The rotating movement provided by the drill rig is transmitted to the drill bit by means of fluted surfaces or splines in both the rearmost part of the drill bit, or shank, and the driver sub. In turn the drill bit head, of larger diameter than the outer casing and than the drill bit shank and driver sub, has mounted therein the cutting elements that fulfill the drilling task and extend forward from the drill bit front face. The movement of the drill bit is limited in its rearward stroke by the driver sub and in its frontward stroke by a retaining element especially provided for said purpose. At the rear end of the hammer a rear sub is provided that connects the hammer with the drill string and ultimately to the source of pressurized fluid.

In the above description and that one hereinafter provided, the rear end of the hammer is understood to be the end where the rear sub is located and the front end of the hammer, the end where the drill bit is located.

Operation of the Hammer

When the hammer operates in the so called "drilling mode", which is explained further along, the front and rear chambers undergo the following states:

- a—supply of pressurized fluid, wherein the fluid coming from the source of pressurized fluid is free to flow into the chamber;
- b—expansion or compression, depending on the direction of the piston's movement, wherein the chamber is tightly sealed and the volume it encloses increases or decreases;
- c—discharge of pressurized fluid, wherein the fluid coming from the chamber is free to flow towards the bottom of the hole; this discharge flow enables flushing of the rock cuttings generated by the drill bit, dragged in suspension in the pressurized fluid flow, towards the ground surface (process known as flushing of the hole).

In accordance with the piston's reciprocating movement, starting from the position in which the piston is in contact with the drill bit and the latter is disposed at the rearmost point of its stroke, position known as impact position, and ending in the same position with the impact of the piston over the drill bit, the respective sequences for the states of the front and rear chambers are the following: [a-b(expansion)-c-b(compression)-a] and [c-b(compression)-a-b(expansion)-c], respectively. The transition from one state to the other is independent for each chamber and is controlled by the position of the piston with respect to other parts of the hammer in such a way that the piston acts in itself as a valve, as well as an impact element.

In a first operative mode or "drilling mode", when pressurized fluid is supplied to the hammer and the hammer is in the impact position, the piston immediately begins the reciprocating movement and the drill bit is impacted in each cycle by the piston, the front end of the drill bit thereby performing the function of drilling the rock at each impact. The rock cuttings are exhausted to the ground surface by the pressurized fluid discharged from the front and rear chambers to the bottom of the hole. As the depth of the hole increases, the magnitude of the pressurized fluid column with rock cuttings also increases, producing a greater resistance to the pressurized fluid discharge from the chambers. This phenomenon negatively affects the drilling process. In some applications, the injection of fluids into the pressurized fluid flow or the leakage of water or other fluids into the hole increases even more this resistance, and the operation of the hammer may cease.

In some hammers, this operative mode of the hammer can be complemented with an assisted flushing system which allows the discharge of part of the flow of pressurized fluid available from the source of pressurized fluid directly to the bottom of the hole without passing through the hammer cycle. The assisted flushing system allows the hole to be cleaned thoroughly while it is being drilled. The pressurized fluid coming from the assisted flushing system has an energy level substantially similar to that of the pressurized fluid coming out from the source of pressurized fluid, as opposed to what happens with the pressurized fluid exhausted from the chambers, which is at a pressure substantially lower due to the exchange of energy with the piston.

In a second operative mode of the hammer or "flushing mode", the drill string and the hammer are lifted by the drill rig in such a way that the drill bit loses contact with the rock and all the pressurized fluid is discharged through the hammer directly to the bottom of the hole for cleaning purposes without going through the hammer cycle, thus ceasing the reciprocating movement of the piston.

Industrial Applications

These drilling tools are used in two fields of industrial application:

1) Production, where a kind of hammer known as "direct circulation hammer" is used, wherein the rock cuttings produced during the drilling operation are flushed to the ground surface through the annular space defined by the wall of the hole and the outer surface of the hammer and the drill string, producing wear on the outer surfaces of the hammer and the drill string by the action of said cuttings. The pressurized fluid coming from the hammer is discharged through a central passage inside the drill bit which extends from its rear end to its front end. This passage may be divided into two or more passages ending at the front face of the drill bit in such a way that the discharge of the pressurized fluid is mainly generated from the center and across the front face of the drill bit towards the peripheral region of the same and towards the wall of the hole, and then towards the ground surface along the annular space between the hammer and the wall of the hole and between the drill string and the wall of the hole. The rock cuttings are exhausted by drag and are suspended in the pressurized fluid discharged to the bottom of the hole.

Direct circulation hammers are used in mining in underground and surface developments. Due to their ability to drill medium to hard rocks, the use of this type of hammers has also extended to the construction of oil, water and geothermal wells. In general, the soil or rock removed is not used as it is not of interest and suffers from contamination on its path to the surface.

2) Exploration, where a kind of hammer known as "reverse circulation hammer" is used, which allows the rock cuttings from the bottom of the hole to be recovered at the ground surface by means of the pressurized fluid discharged to the bottom of the hole. The pressurized fluid coming from the hammer is discharged along the peripheral region of the front end of the drill bit, therefore producing a pressurized fluid flow across the front face of the drill bit towards the inside of a continuous central passage formed along the center of the hammer, typically through an inner tube known as sampling tube extending from the drill bit to the rear sub, and through the double walled rods that conform the drill string. This central passage begins in the inside of the drill bit at a point where two or more recovery passageways originated at the front face of the drill bit converge. The rock cuttings are dragged towards the central passage by the action of the pressurized fluid, said rock cuttings being recovered at the ground surface. The pressurized fluid flow with suspended rock cuttings produce wear on the inner surfaces of all the elements that form said central passage.

Either, the drill bit or a cylindrical sealing element of the hammer which has a diameter substantially similar to the diameter of the drill bit head and larger than the external diameter of the outer casing, performs the function of preventing the leakage of pressurized fluid and rock cuttings into the annular space between the hammer and the wall of the hole and between the drill string and the wall of the hole when the hole is being drilled, as happens with a direct circulation hammer, forcing these cuttings to travel through the sampling tube and drill string to the ground surface by the action of the pressurized fluid. If the drill bit performs this sealing function, it has a peripheral region that isolates the front face of the drill bit from said annular space.

The use of this type of drilling tools allows for the recovery of most of the rock cuttings, which do not suffer from contamination during their travel to the ground surface and are stored for further analysis.

Performance Variables

From the user's point of view, the variables used to evaluate the performance and usefulness of the hammer are the rate of penetration. durability of the hammer, consumption of pressurized fluid, deep drilling capacity, reliability of the hammer and rock cuttings recovery efficiency (only for reverse circulation hammers). All these factors have direct incidence in the operational cost for the user. In general, a faster and reliable hammer having a useful life within acceptable limits will always be preferred for any type of application.

Pressurized Fluid Flow Systems

Different pressurized fluid flow systems are used in hammers for the process of supplying the front chamber and the rear chamber with pressurized fluid and for discharging the pressurized fluid from these chambers. In all of them there is a supply chamber formed inside the hammer from which the pressurized fluid is conveyed to the front chamber or to the rear chamber.

In most of those pressurized fluid flow systems the supply and discharge process are geometrically determined and depend on the position of the piston. In these cases, the piston acts as a valve, in such a manner that depending on its position is the state in which the front and rear chambers are, these states being those previously indicated: supply, expansion-compression and discharge.

At all times the net force exerted on the piston is the result of the pressure that exists in the front chamber, the area of the piston in contact with said chamber (or front thrust area of the piston), the pressure that exists in the rear chamber, the area of the piston in contact with said chamber (or rear thrust area of the piston), the weight of the piston and the dissipative forces that may exist. The greater the thrust areas of the piston, the greater the force generated on the piston due to a certain pressure level of the pressurized fluid, and greater the power and the energy conversion efficiency levels which can be potentially achieved.

In the section "Pressurized Fluid Flow Systems" of U.S. Pat. No. 10,316,586 can be found a description of the prior art related to pressurized fluid flow systems (Type A to Type E Flow Systems), except for the newest Type F Flow System which is described later in this application. All of them are described with regard to the solutions for controlling the state of the front and rear chambers of a DTH hammer through the piston and its relative position with respect to other elements that are part of the hammer. The examples described refer to direct circulation hammers, but they are equally applicable to reverse circulation hammers.

Reverse circulation hammers differ from direct circulation hammers with regard to the solutions for conveying the pressurized fluid discharged from the front chamber and from the rear chamber to the bottom of the hole, specifically to the periphery of the front face of the drill bit, for flushing of rock cuttings. These exhaust Flow Systems are also, but partially discussed, in the section "Pressurized Fluid Flow Systems" of U.S. Pat. No. 10,316,586 (Type 1 Flow System and Type 2 Flow System). A third type, which can be identified as a Type 3 Flow System, is represented by U.S. Pat. Nos. 8,973,681 and 9,016,403B2.

Finally, Valve Systems (Type V1 to Type V3 Valve Systems) are discussed in this application. The "valve" is an element that can complement or even replace some of the porting functions played by one or more parts of the hammer, or some features in them, in the hammer cycles according to the descriptions in the Type A to Type F Flow Systems.

Type F Flow System, Represented by U.S. Pat. Nos. 10,316,586 and 11,174,679

As in the type E flow system, the designs described in these documents comprise a cylinder mounted inside the outer casing, the cylinder creating supply channels for supplying pressurized fluid to the front and rear chambers of the hammer, and discharge channels for discharging pressurized fluid from the front and rear chambers. In these designs, the supply and discharge channels are defined by respective recesses disposed in parallel longitudinally between the outer surface of the cylinder and the inner surface of the outer casing. As in the type E flow system, the former designs represent an advantage because no alignment problems must be expected since the piston only slides within the cylinder. These designs also offer a completely solid piston since the flows of pressurized fluid to and from the front and rear chambers occur externally to the piston. There are no holes or passages that weaken the piston resulting also in a simpler manufacturing process.

In the following paragraphs the different known DTH hammers' valve systems are exemplified. In this context, the "valve" element participates in and influences the process of supplying the rear chamber, and in some cases the front chamber, with pressurized fluid. The valve can also influence the process of discharging the pressurized fluid from one or both chambers. The valve systems will be described based on their functionality and based on the way they are controlled.

Type V1 Valve System, Represented by U.S. Pat. Nos. 5,085,284, 5,301,761 and 8,631,884

The designs described in these patents use as a base a geometrically determined Type A flow system and make use of a valve slidably mounted on the rear face of the rear chamber to generate an asymmetric feeding process of the rear chamber. The valve is actuated by means of three main thrust surfaces exposed respectively to a pressure close to the one existing in the bottom of the hole, to a pressure close to the "stagnation pressure" of the flow coming from the source of pressurized fluid just after it enters the hammer and to the pressure in the rear chamber. In U.S. Pat. No. 8,631,884, the first surface is exposed to a pressure close to the one existing in the bottom of the hole when the valve is closed, but when the valve is open the pressure acting on this surface changes to a pressure somewhere in between the static pressure of the flow coming from the source of pressurized fluid and the pressure in the rear chamber.

The main problems with this type of valve system are two. First, the pressure existing in the bottom of the hole vary drastically with the depth of the hole being drilled, causing in this way a change in the timing of the valve and so in the hammer behavior, and second, when a thrust surface is exposed to a flow the static pressure depends on the flow velocity and can be as low as half of the "stagnation" pressure.

Type V2 Valve System, Represented by U.S. Pat. Nos. 2,823,013 and 3,169,584

The designs described in these patents use a valve to control the filling of the front and rear chambers with pressurized fluid while the discharge of both chambers only depends on the piston position relative to a cylinder or inner sleeve.

The two possible valve states are either front chamber supply open-rear chamber supply closed, or front chamber supply closed-rear chamber supply open. In the first case, the rear face of the valve is exposed to a pressure lower to the one existing in the distributor, specifically in the feeding chamber, from where pressurized fluid is directed to the front chamber (how much lower depends on the flow velocity through the rear face of the valve), and the front face of the valve is exposed to the pressure existing in the rear chamber. In the second case, the front face of the valve is exposed to a pressure close to the one existing in the distributor, from where pressurized fluid is directed to the rear chamber, and the front face of the valve is exposed to the pressure existing in the front chamber.

The pressures needed in the rear and front chambers to respectively move the valve to its upper and lower positions are achieved by means of quasi-adiabatic compression processes in the respective chambers. In the "mode of operation" described in U.S. Pat. No. 2,823,013, when the ram (piston) is moving upward, it is possible to see that the rear chamber starts the compression process from a pressure equal or close to the bottom hole pressure. The first main issue with this approach is that the bottom hole pressure changes and increases with the depth of the well being drilled, which implies that the hammer behavior as a whole, and particularly the valve behavior, changes during the deepening of the hole. The second issue is that the rear chamber feeding starting-finishing points are not independent of the front chamber feeding starting-finishing points which results in a too short frontward acceleration stroke or in an excessive deacceleration stroke due to a long feeding process of the front chamber during the frontward stroke. The third issue is that the pressure existing on the rear face of the valve is not the one existing in the front chamber, but the static pressure of the flow stablished between the distributor and the front chamber which in turns depends on the flow velocity and as explained before, can be as low as half of the "stagnation" pressure of the flow entering the hammer. Finally, because the front chamber feeding starting-finishing points are controlled at the valve level, all the feeding passages need to be filled with pressurized fluid retarding the filling of the front chamber with pressurized fluid and increasing in this way the passive volume and air consumption.

Type V3 Valve System, Represented by U.S. Pat. No. 8,006,776

The design described in this patent uses as a base a geometrically determined Type B flow system and make use of a ported valve slidably mounted externally to the pressurized fluid supply tube and inside the piston to control the filling of the rear chamber and the filling of the front chamber with pressurized fluid. The purpose of this valve system is to take advantage of the well-known benefits of an asymmetric timing that looks for an extended pressurization of the rear (or power) chamber and a reduced pressurization of the front (or return) chamber of the hammer during the frontward stroke.

The main problem with this design is that all the "biasing devices" envisioned fall into the spring kind. These types of devices have two disadvantages, they are prone to failure due to fatigue which can be exacerbated by corrosion induced by the presence of brine water in the pressurized fluid flow and the force-displacement characteristic behavior is dependent on the compression of the "spring kind" biasing device.

A valuable explanation about asymmetric timing advantages can be found in the section "DETAILED DESCRIPTION OF THE INVENTION".

OBJECTIVES OF THE INVENTION

According with the issues and technical antecedents stated, it is a goal of the present invention to present a valve system applicable to normal or reverse circulation hammers based on Type F and other Flow Systems that allows an asymmetric feeding of the rear chamber that is also less sensitive to bottom hole pressure. The advantages that can be obtained through an asymmetric feeding are three:

- Avoid the piston deceleration during the frontward stroke, close to the impact position, due to the filling of the front chamber with pressurized fluid.
- Increase the piston acceleration during the frontward stroke keeping the flow of pressurized fluid into the rear chamber open further the point where the piston closes the geometrically determined filling fluid path.
- Take advantage of the natural imbalanced profile of the pressures inside the front and rear chambers that naturally occurs in DTH hammers to obtain a hammer cycle less sensitive to the bottom hole pressure.

Specifically, the use of this novel valve system will improve the base flow system of the hammer allowing achieve a higher power and/or a higher efficiency in the energy conversion process, which implies a higher penetration rate, in a wide range of depths. All of this without sacrificing the hammer's useful life or decrease its reliability and sturdiness.

As stated before, a "valve" is an element that can complement or even replace some of the porting functions played by one or more parts of the hammer, or some features in them, in the hammer cycles according to the descriptions in the Type A to Type F Flow Systems. In this way, the use of this novel valve system can be used to simplify the base Flow System or make some parts sturdier.

A thorough discussion about asymmetric timing advantages can be found in U.S. Pat. No. 8,006,776 in the section "DETAILED DESCRIPTION OF THE INVENTION".

BRIEF SUMMARY OF THE INVENTION

With the purpose of providing an improved pressurized fluid flow system for a DTH hammer according to the above-defined goals, a valve system has been devised that uses the natural imbalanced profile of the pressures inside the front and rear chambers that naturally occurs in DTH hammers. The valve system of the invention is characterized by having a valve located on the rear face of the rear chamber. This valve has two main surfaces: a rear surface being exposed partially or totally, depending on if the valve is in its open or close position respectively, to the front chamber pressure through a longitudinal passageway, and a front surface being exposed partially or totally, depending on if the valve is in its close or open position respectively, to the rear chamber pressure. The longitudinal passageway has a small sectional area and has the purpose of transmitting the pressure inside the front chamber onto the rear valve's surface, pressure that is not distorted due to the lack of any flow through the passageway, meanwhile on the valve's front surface acts the pressure inside the rear chamber.

Auxiliary surfaces can be added to the valve with the purpose of biasing its behavior. These auxiliary surfaces are exposed to the pressure of the fluid flow coming directly from the source of pressurized fluid.

- In plot 1A are represented the absolute pressures inside the front and rear chambers (Y-axis) against time (X-axis) with segmented and continuous lines respectively. Points A and B represent the points during a single piston cycle where the pressures inside both chambers are equal.
- In plot 1B is represented the piston position (Y-axis) against time (X-axis). Piston position is measured from the impact position where its value is cero and positive rearward. Points A and B are also represented.
- In plot 1C are represented the absolute pressures inside the front and rear chambers (Y-axis) against the piston position (X-axis) with segmented and continuous lines respectively. Points A and B are also represented. Arrows are used to show the direction of the pressure cycles: clockwise for the front chamber and counter-clockwise for the rear chamber.

In all these plots, square marks have been used to point out timing limits for the front chamber and triangular marks have been used to point out timing limits for the rear chamber.

Numbers have also been used to point out timing limits. Numbers one (1) indicate the impact position for both chambers and numbers four (4) indicate the maximum stroke position (a small shift has been used when these points overlap). Meanwhile, numbers two, three, five and six (2, 3, 5 and 6) have been used to point out the chambers' timing limits (cycle phases limits) described formerly in the section "operation of the hammer":

- a—supply of pressurized fluid, wherein the fluid coming from the source of pressurized fluid is free to flow into the chamber. Process through points 6-1-2 for the front chamber and process through points 3-4-5 for the rear chamber.

b—expansion or compression, depending on the direction of the piston's movement, wherein the chamber is tightly sealed and the volume it encloses increases or decreases. Processes through points 5-6 (compression) and 2-3 (expansion) for the front chamber, and processes through points 5-6 (expansion) and 2-3 (compression) for the rear chamber.

c—discharge of pressurized fluid, wherein the fluid coming from the chamber is free to flow towards the bottom of the hole. Process through points 3-4-5 for the front chamber and process through points 6-1-2 for the rear chamber.

Figure 2:
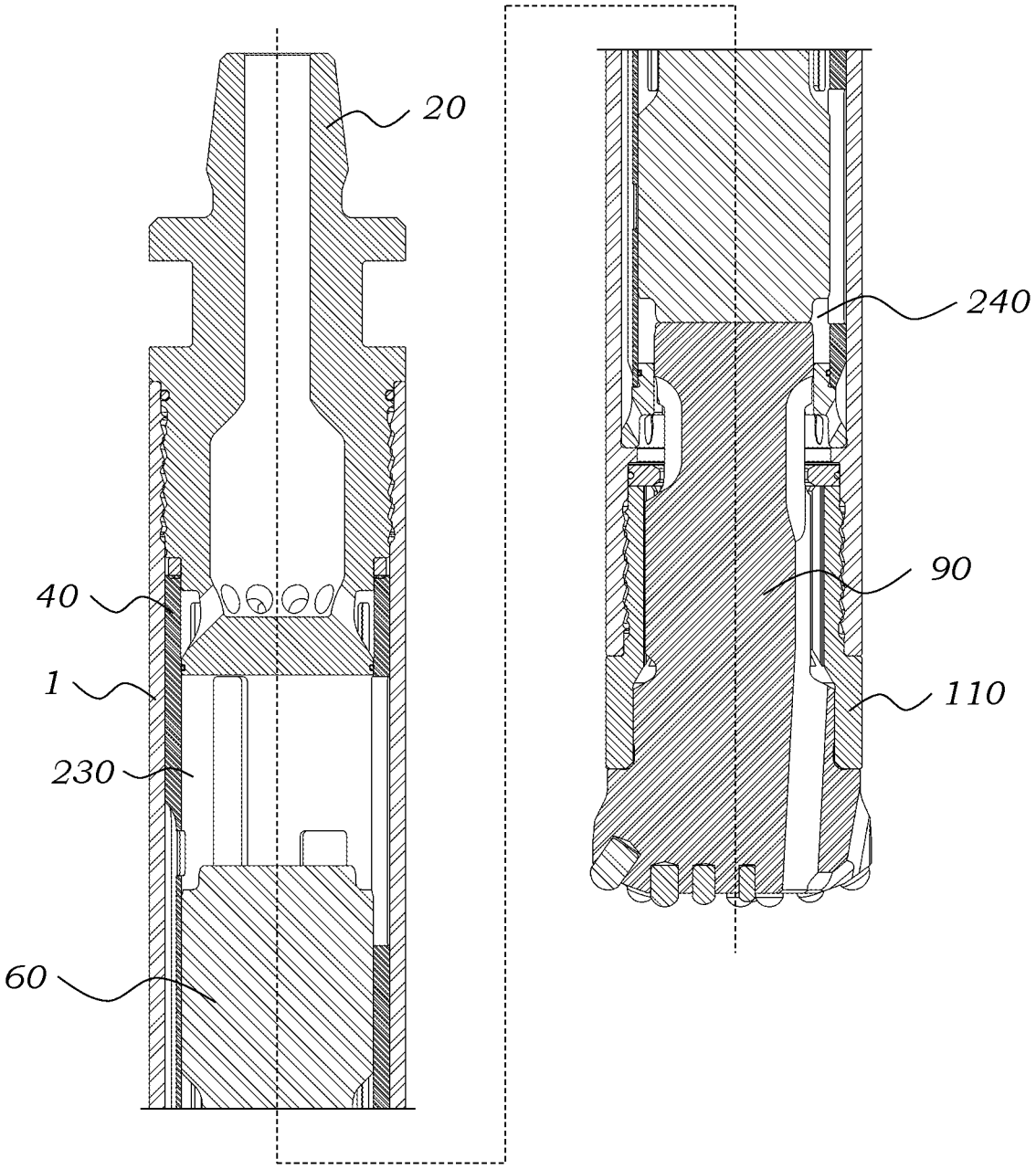

FIG. 2 depicts a longitudinal cross section view of a DTH hammer with a Type F flow system, specifically showing its main components: rear sub (20), outer casing (1), driver sub (110), drill bit (90), piston (60) and cylinder (40). The rear chamber (230) and the front chamber (240) are also identified. The piston is shown in the impact position.

Figure 3:
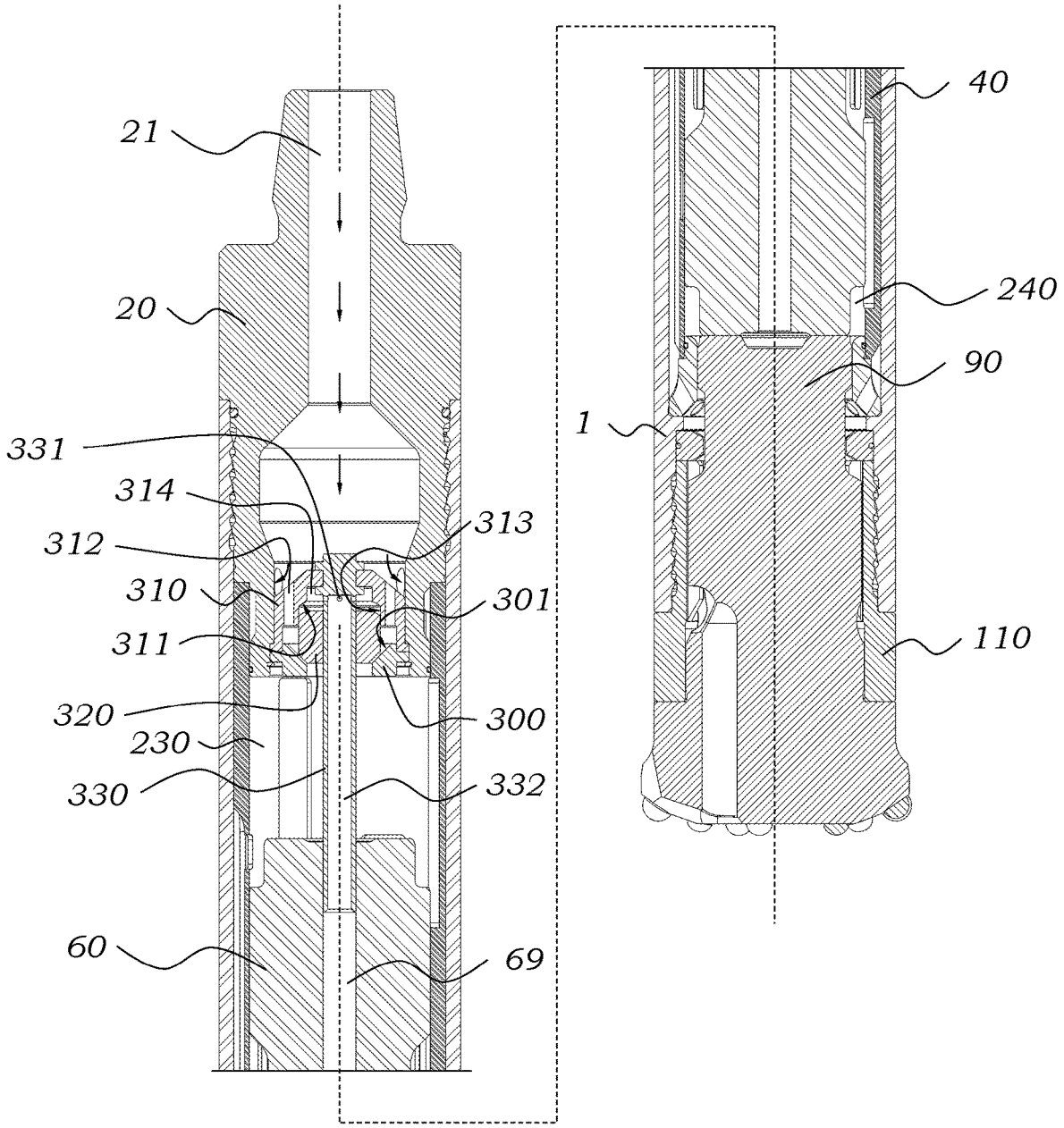

FIG. 3 depicts a longitudinal cross section view of a DTH hammer with a Type F Flow System and a first preferred embodiment of the valve system of the invention, specifically showing the valve in its close position.

Figure 4:
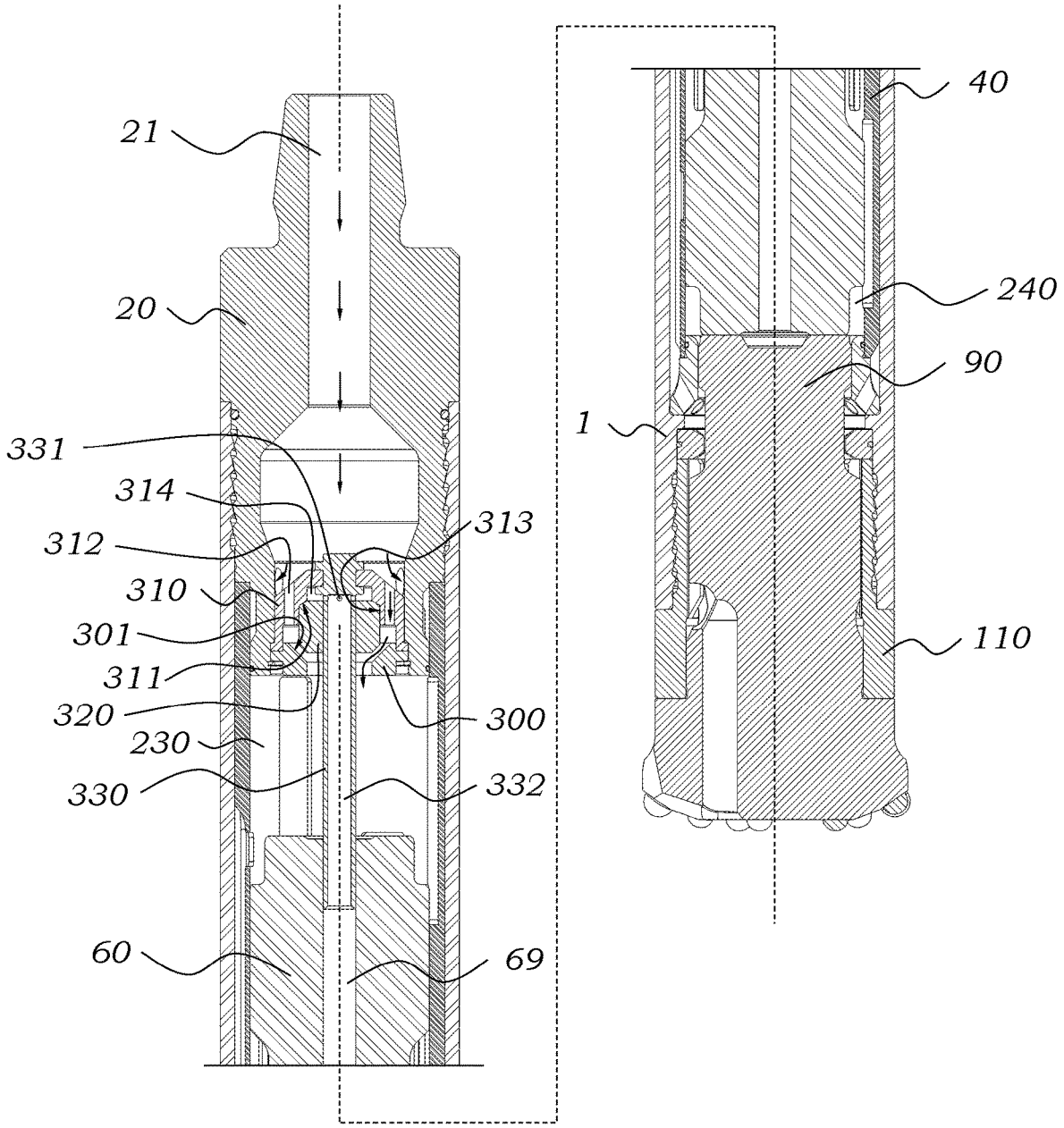

FIG. 4 depicts a longitudinal cross section view of a DTH hammer with a Type F Flow System and the first preferred embodiment of the valve system of the invention, specifically showing the valve in its open position.

Figure 5:
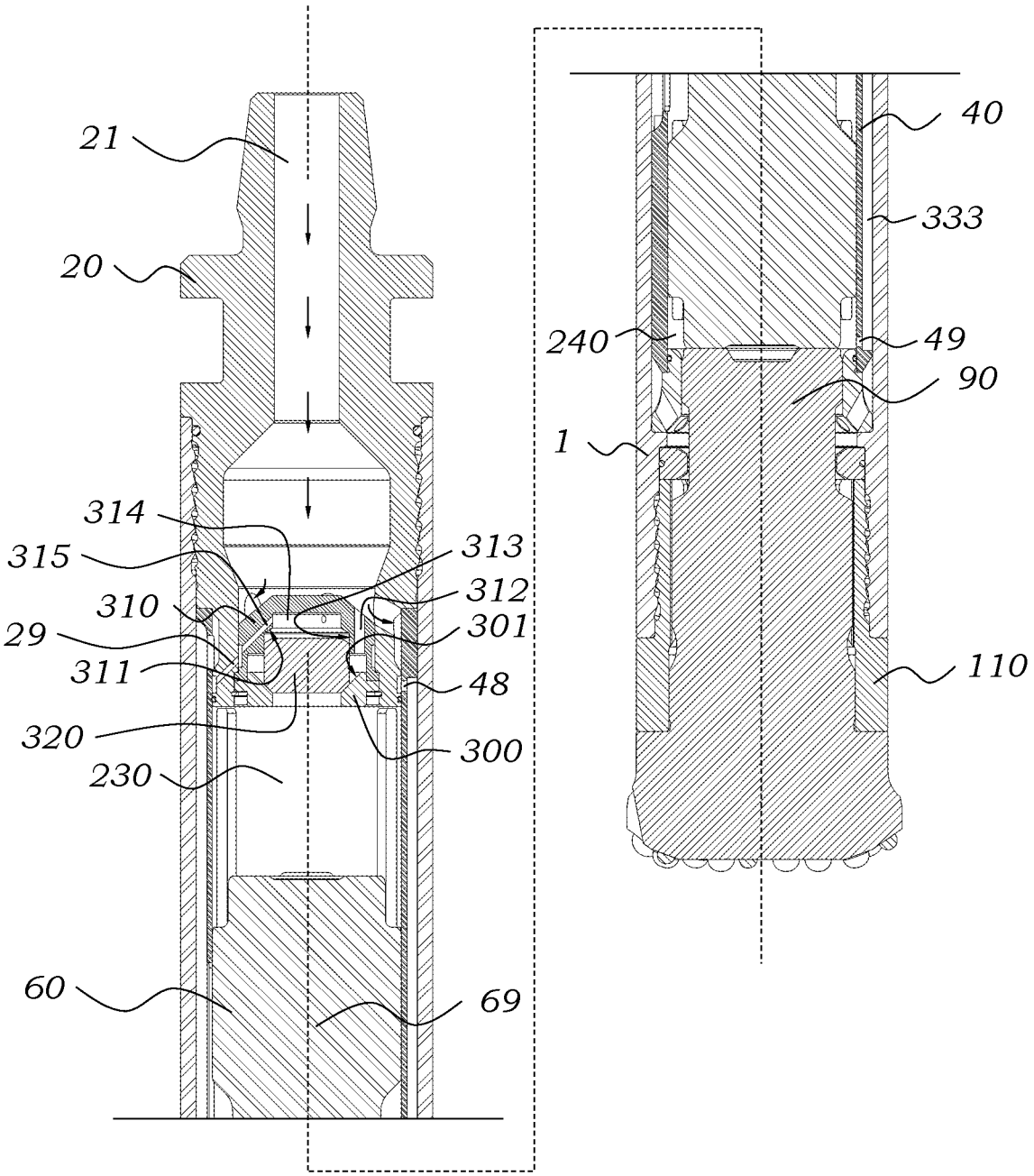

FIG. 5 depicts a longitudinal cross section view of a DTH hammer with a Type F Flow System and a second preferred embodiment of the valve system of the invention, specifically showing the valve in its close position.

Figure 6:
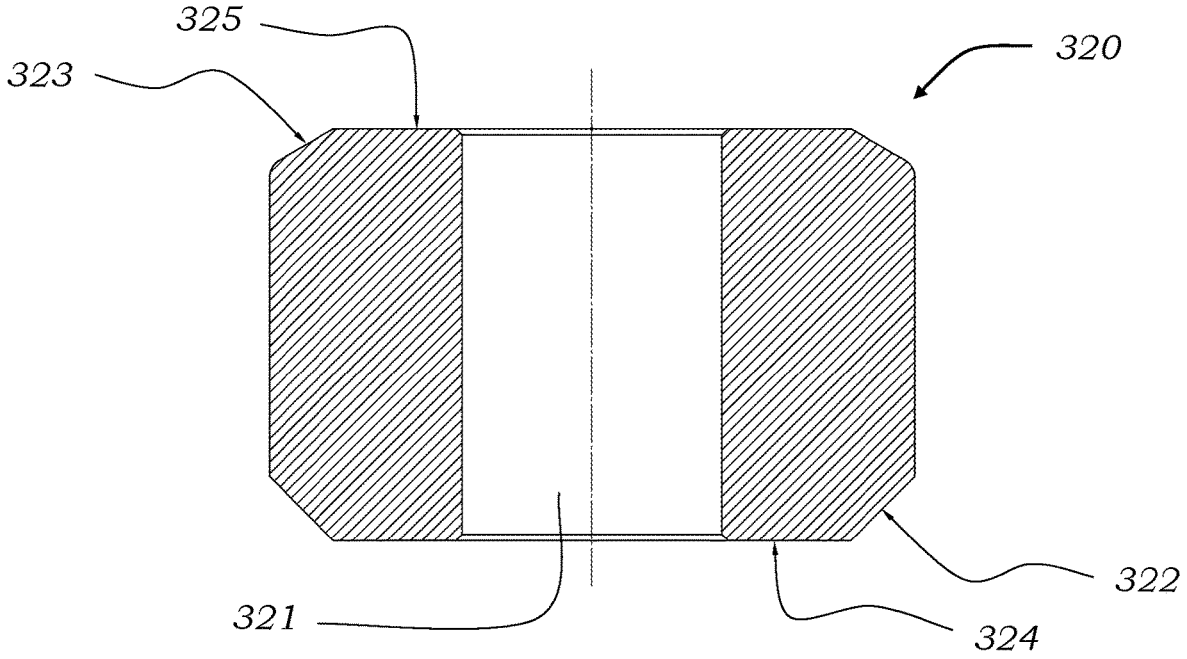

FIG. 6 depicts the valve of the first preferred embodiment of the valve system of the invention.

Figure 7:
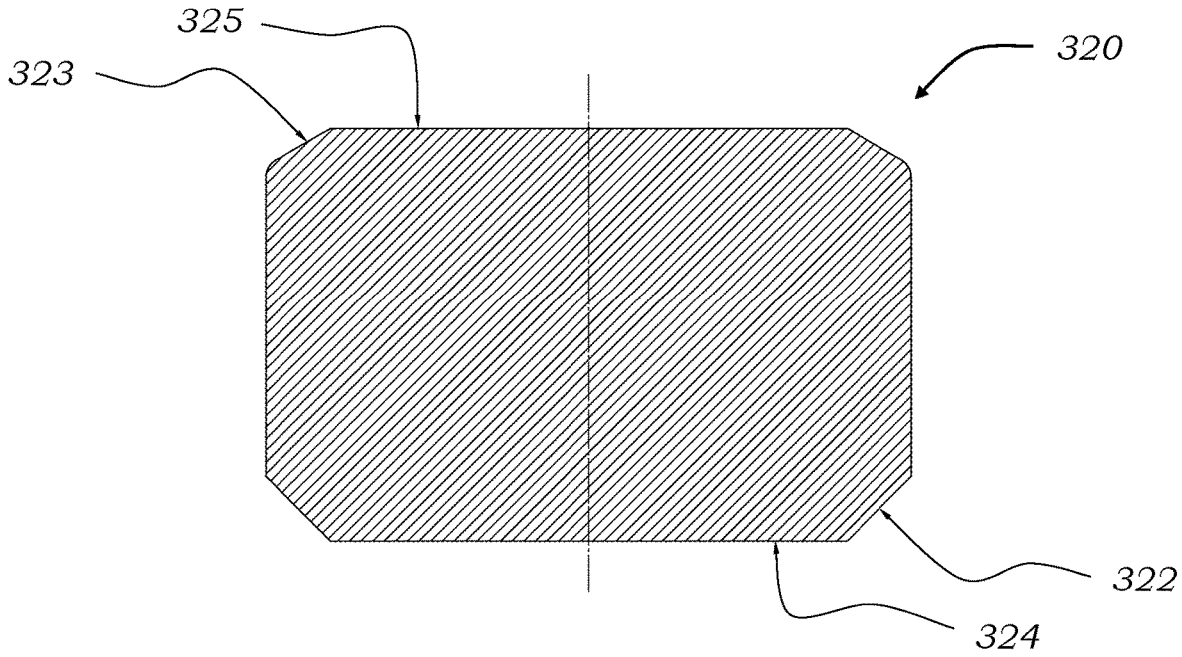

FIG. 7 depicts the valve of the second preferred embodiment of the valve system of the invention.

Figure 8:
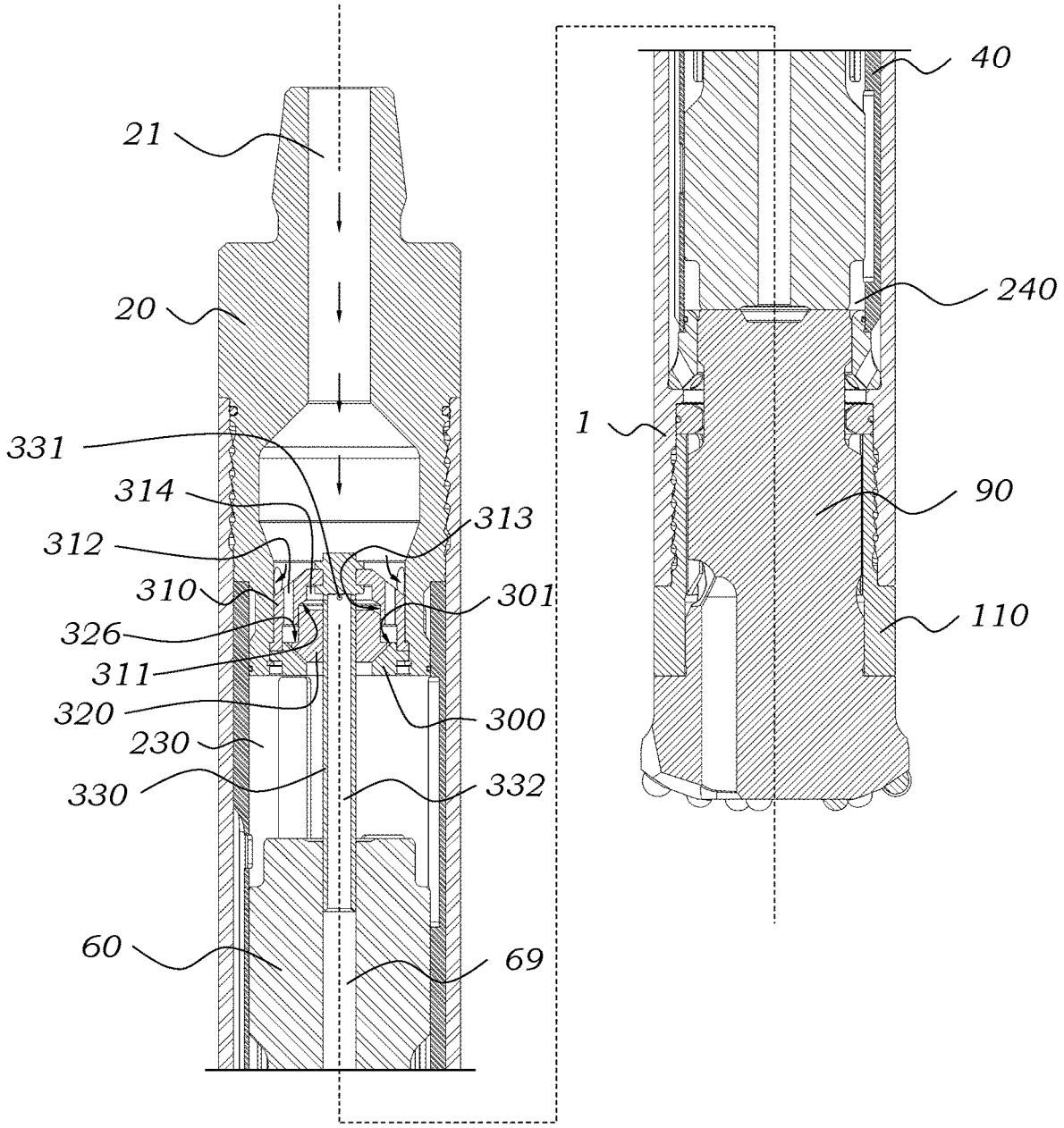

FIG. 8 depicts a longitudinal cross section view of a DTH hammer with a Type F Flow System and the first preferred embodiment of the valve system of the invention, specifically showing the valve in its close position, where the valve has a biasing thrust area.

Figure 9:
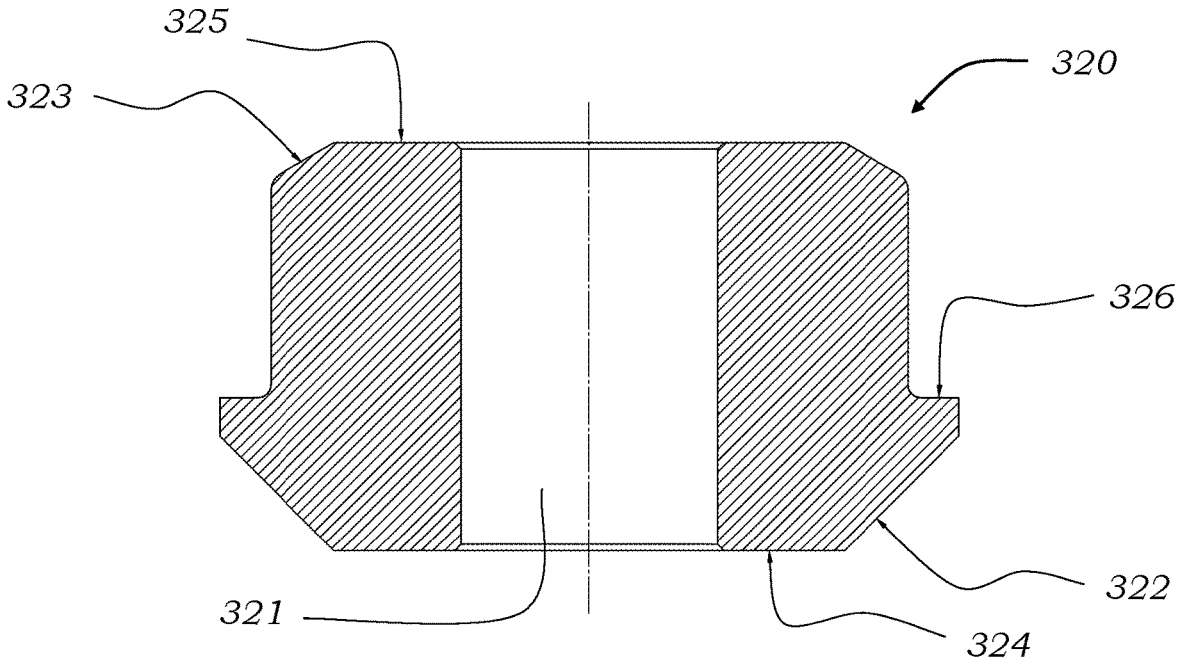

FIG. 9 depicts the valve of the first preferred embodiment of the valve system of the invention, where the valve has a biasing thrust area.

Figure 10:
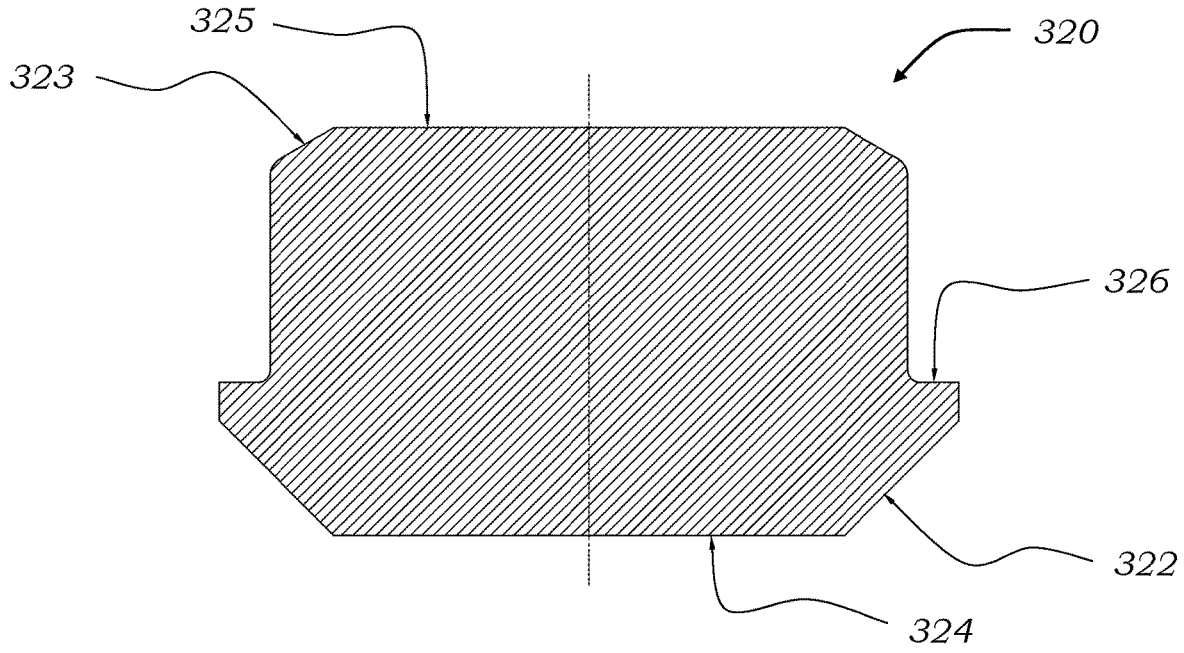

FIG. 10 depicts the valve of the second preferred embodiment of the valve system of the invention, where the valve has a biasing thrust area.

DETAILED DESCRIPTION OF THE INVENTION

Referring to FIG. 2, a direct circulation DTH hammer is shown that has a Type F Flow System and comprises the following main components:

a cylindrical outer casing (1) having a rear end and a front end;

a rear sub (20) mounted to said front rear end of the outer casing (1);

a driver sub (110) mounted to said front end of the outer casing (1);

a piston (60) slidably and coaxially disposed inside said outer casing (1);

a drill bit (90) slidably mounted on the driver sub (110);

a cylinder (40) that is coaxially disposed in between the outer casing (1) and the piston (60);

a rear chamber (230);

and a front chamber (240);

Referring to FIGS. 3, 4 and 6, the first preferred embodiment of the valve system of the invention is shown implemented in a direct circulation DTH hammer that has a Type F Flow System. The preferred embodiment of the valve system of the invention comprises the following main components:

A valve carrier (300) mounted at the front end of the rear sub (20), the valve carrier (300) having a rear valve support surface (301);

A probe carrier (310) mounted on the rear end of the valve carrier (300), the probe carrier (310) having a front valve support surface (311), one or more fluid passageways (312) and an inner sliding surface (313);

A valve (320) mounted in the space between the valve carrier (300) and the probe carrier (310) capable of slide on the sliding surface (313) of the probe carrier (310) for moving between a close position and an open position, the valve (320) having a central bore (321), a front support surface (322), a rear support surface (323), a front thrust surface (324), a rear thrust surface (325) and creating together with the probe carrier (310) a pressurized volume (314);

A longitudinal central bore (69) machined along the entire piston (60) body;

A probe (330) mounted on the rear end of the probe carrier (310), the probe (330) extending along the central bore (321) of the valve (320) and extending in part or totally along the longitudinal central bore (69) of the piston (60). The probe (330) fitting the valve (320) on its external surface and having one or more ports (331) and at least one longitudinal passageway (332) for connecting the pressurized volume (314) with the front chamber (240);

How the Valve Works in the First Preferred Embodiment of the Valve System of the Invention At any moment of the piston cycle, the pressure acting on the rear thrust surface (325) of the valve (320) is equal to the pressure inside the front chamber (240) because the pressurized volume (314) created between the probe carrier (310) and the valve (320) is in direct communication with the front chamber (240) through the ports (331) and the passageway (332) of the probe (330) and through the central bore (69) of the piston (60) and because no flow of pressurized fluid is stablished through this path. In a similar way, at any moment of the piston cycle, the pressure acting on the front thrust surface (324) of the valve (320) is equal to the pressure inside the rear chamber (230) because the front thrust surface (324) is directly exposed to the fluid inside the rear chamber (230).

Figure 1A:
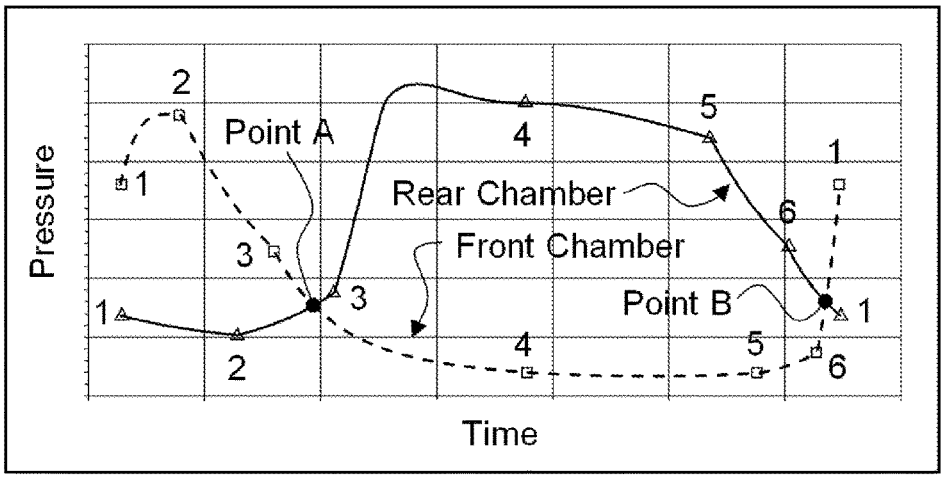
FIG. 1 shows three plots labeled A, B and C. These plots represent the typical behavior for a hammer where the porting depends solely on the relative position of the piston and other auxiliary parts, like the cylinder in the Type F Flow Systems, during the alternating movement of the piston. These hammers are known as valveless hammers.
Figure 1B:
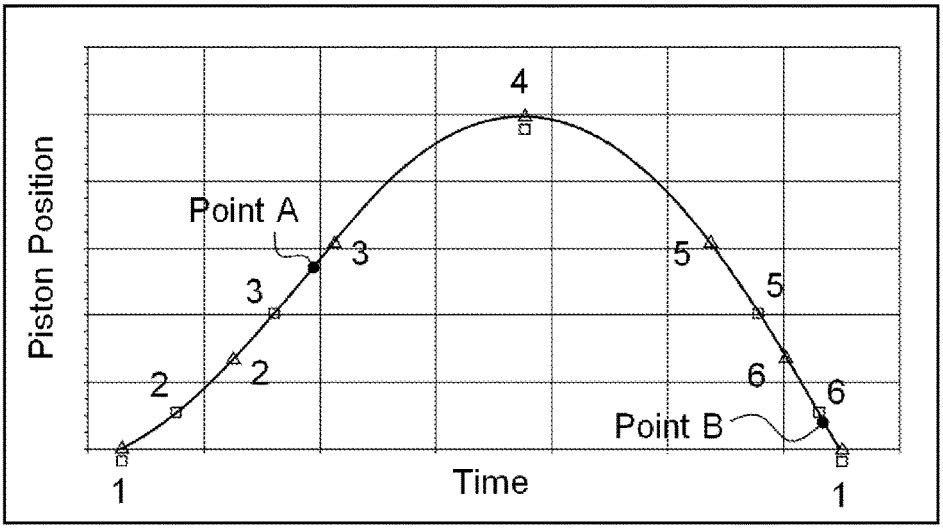
Figure 1C:
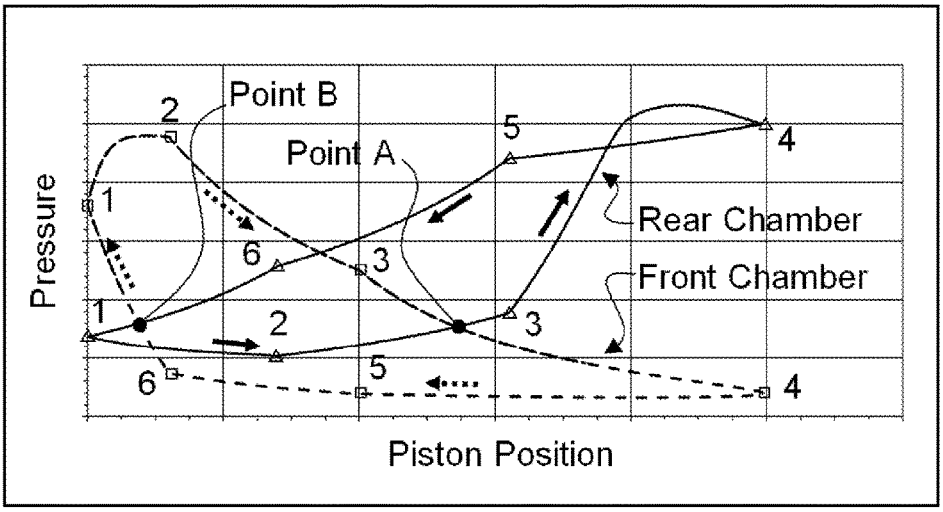

Starting from the impact position (see point 1 in the left side of FIG. 1B) and with the valve (320) in its frontmost position (closed position), the piston (60) moves rearward until it reaches point A where the pressures in the rear and front chambers (230,240) equalize. Because the front support surface (322) of the valve (320) is resting on the rear valve support surface (301) of the valve carrier (300) and the rear support surface (323) of the valve (320) is exposed to the pressurized volume (314) a pressure in the rear chamber (230) higher than the pressure in the front chamber (240) is needed to open the valve (320). After point A and depending on the values of the front thrust surface (324), the rear support surface (323) and the rear thrust surface (325), the valve opens. Ideally, areas must be set up in such a way that the valve (320) opens close after point 3 of the rear chamber (230) cycle is surpassed (see rear chamber diagram in FIG. 1C).

When the valve (320) is open, pressurized fluid is allowed to flow inside the rear chamber (230) from the source of pressurized fluid through the central hole (21) in the rear sub (20), through the fluid passageways (312) and in between the front support surface (322) of the valve (320) and the rear valve support surface (301) of the valve carrier (300). This pressurized fluid flow into the rear chamber (230) complements the flow of fluid coming from the source of pressurized fluid that is free to flow into the rear chamber (230) during the process 3-4-5 (see rear chamber diagram in FIG. 1C), where points 3 and 5 are determined by the relative position between the piston (60) and the cylinder (40).

After the piston (60) reaches its maximum stroke (points 4 in FIGS. 1A, 1B and 1C) it starts its frontward stroke. After point 4, the rear chamber (230) continues its filling process through the valve (320) and through the geometrically determined filling fluid path, the last remaining open until the piston (60) closes it at point 5 (see rear chamber diagram in FIG. 1C). Nevertheless, after point 5 the filling process of the rear chamber (230) through the valve (320) continues.

After point 6 in the rear chamber (230), the piston (60) will open the discharge of the rear chamber (230) to the bottom of the hole and the pressure inside the rear chamber (230) will drops rapidly causing that the pressures in the rear and front chambers (230,240) equalize again past point B.

Because the rear support surface (323) of the valve (320) is resting on the front valve support surface (311) of the probe carrier (310) and the front support surface (322) of the valve (320) is exposed to the pressure of the flow through the valve, which accelerates due to the pressure drop, a pressure in the front chamber (240) slightly higher than the pressure in the rear chamber (230) is needed to close the valve (320). After point B and depending on the values of the front thrust surface (324), the front support surface (322) and the rear thrust surface (325), the valve closes. Ideally, areas must be set up in such a way that the valve (320) closes close after point B (see rear chamber diagram in FIG. 1C). Once point 1 is reached, the cycle starts again.

The less resistance offered to the fluid flow coming from the source of pressurized fluid by the open (to the bottom of the hole) rear chamber (230) in comparison with the resistance offered by the front chamber (240) when its geometrically determined filling fluid path is open in the frontward stroke (subprocess 6-1 in FIG. 1C) also allows a slower filling of the front chamber (240) avoiding in this way the piston deceleration during the frontward stroke, close to the impact position.

How the Valve Works in the Second Preferred Embodiment of the Valve System of the Invention Referring to FIGS. 5 and 7, a second preferred embodiment of the valve system of the invention is shown implemented in a direct circulation DTH hammer that has a Type F Flow System. The second preferred valve system follows the same operation principles and comprises the following main components:

A valve carrier (300) mounted at the front end of the rear sub (20), the valve carrier (300) having a rear valve support surface (301);

A probe carrier (310) mounted on the rear end of the valve carrier (300), the probe carrier (310) having a front valve support surface (311), one or more fluid passageways (312), an inner sliding surface (313) and one or more secondary fluid passageways (315);

The rear sub (20) having one or more secondary fluid passageways (29);

A valve (320) mounted in the space between the valve carrier (300) and the probe carrier (310), the valve (320) having a front support surface (322), a rear support surface (323), a front thrust surface (324), a rear thrust surface (325) and creating together with the probe carrier (310) a pressurized volume (314);

The cylinder (40) having at least one longitudinal passageway (333), and rear ports (48) and front ports (49) in the rear and front ends of the longitudinal passageways (333) for connecting the front chamber (240) with the pressurized volume (314) through the secondary fluid passageways (315) in the probe carrier (310) and through the secondary fluid passageways (29) in the rear sub (20);

This valve system follows the same operation principles it does in the first preferred embodiment of the valve system of the invention. The only difference is how the purpose of that, at any moment of the piston cycle, the pressure acting on the rear thrust surface (325) of the valve (320) be equal to the pressure inside the front chamber (240) is achieved. In the second preferred embodiment of the valve system of the invention, the pressurized volume (314) created between the probe carrier (310) and the valve (320) is in direct communication with the front chamber (240) through the secondary fluid passageways (315) in the probe carrier (310), through the secondary fluid passageways (29) in the rear sub (20), and through the rear ports (48), the longitudinal passageways (333) and the front ports (49) in the cylinder (40).

Design Considerations

The first preferred embodiment and the second preferred embodiment of the valve system described previously are only two of many variations of the valve system of the invention that can be envisioned, including for example longitudinal passageways equivalent to passageways (333) but on the inner surface or even in the wall of the outer casing (1).

It will be appreciated by those skilled in the art that other changes, besides the ones mentioned above, could be made to the embodiments described above without departing from the broad inventive concept thereof. It is understood, therefore, that this invention is not limited to the embodiments disclosed, but it is intended to cover modifications within the spirit and scope of the present invention. One of those changes can be to completely remove the rear set of recesses that allows the geometrically determined supply of pressurized fluid to the rear chamber in hammers that use, for example, the Type F Flow System, letting in this way the valve be the only mean for feeding that chamber allowing the simplification of the base Flow System or make some parts sturdier. In a similar fashion, the probe carrier (310) and the valve carrier (300) don't need to be separated parts and can be built in in the rear sub (20) and in the cylinder (or sleeve) respectively. These kinds of changes must be considered obvious.

With respect to the front and rear support surfaces (322, 323) they are not required to be equal and can be modified according to the hammer operation requirements. Moreover, those surfaces (322, 323) can be reduced to almost cero just mismatching the angles of those surfaces with respect to the front valve support surface (311) of the probe carrier (310) and the rear valve support surface (301) of the valve carrier (300), respectively. In both cases the effect is achieve an earlier change in the state of the valve (320) because surfaces (322, 323) would be always subject to the rear chamber (230) and front chamber pressures (230).

In FIG. 5, the probe carrier (310) and the rear sub (20) have surficial undercuts to avoid the need of alignment between the ports (48) and passageways (29) and between passageways (29) and passageways (315). Because this is an obvious design solution, those undercuts are not considered critical features of the invention.

Valve System Biasing

The valve system described before allows to increase the DTH hammer power. In situations where increase the efficiency is also important, which means improve the DTH hammer power to pressurized fluid consumption ratio, or the flow rate coming from the source of pressurized fluid is limited, a biasing surface (326) can be added to the valve (320).

FIG. 8 shows a longitudinal cross section view of a DTH hammer with a Type F Flow System and the first preferred embodiment of the valve system of the invention when the valve (320) is in its close position, and it has a biasing thrust area (326). Whereas FIGS. 9 and 10 show the valve (320) of the first preferred embodiment and the valve (320) of the second preferred embodiment respectively, both having a biasing thrust area (326).

When the valve (320) is closed, the pressure acting on the biasing thrust area (326) is equal to the pressure generated by the source of pressurized fluid (stagnation pressure). The force exerted on the biasing thrust area (326) is added to the force exerted on the rear support surface (323) and the rear thrust surface (325) due to the pressure inside the front chamber (240). In this way, the effect of the biasing thrust area (326) of the valve (320) is delay the opening of the valve (320).

In a similar fashion, when the valve (320) is open, the pressure acting on the biasing thrust area (326) is also equal to the pressure generated by the source of pressurized fluid (stagnation pressure), but the force exerted on the opposite side, on the additional portion of the front support surface (322), is lower due to the drop in the pressure caused by the flow of pressurized fluid in between the front support surface (322) of the valve (320) and the rear valve support surface (301) of the valve carrier (300). In this way, the second effect of the biasing thrust area (326) of the valve (320) is achieve an earlier closing of the valve (320).

The invention claimed is:

1. A percussive drilling tool comprising:

a cylindrical outer casing having a rear end and a front end;

a rear sub affixed to said rear end of the outer casing for connecting the percussive drilling tool to a source of pressurized fluid;

a drill bit mounted to said front end of the outer casing;

a piston slidably disposed inside said outer casing and capable of reciprocating due to a change in pressure of the pressurized fluid contained inside of a rear chamber and a front chamber located at opposites sides of the piston; and a valve slidably mounted between a valve carrier and a probe carrier, the valve having a valve front thrust surface in communication with the rear chamber and a rear thrust surface in communication with a pressurized volume formed by surfaces of the probe carrier and the valve;

wherein said pressurized volume is isolated from high pressure flow coming from the source of pressurized fluid, and wherein the pressurized volume is in communication with the front chamber through at least one passageway defined cooperatively by a longitudinal passageway in a probe and by a longitudinal bore in the piston extending therethrough, the longitudinal passageway in the probe being open to the pressurized volume in its rear end and the longitudinal bore in the piston being open to the front chamber in its front end.

2. The percussive drilling tool of claim 1, wherein the valve further includes a front support surface for engaging a rear valve support surface on the valve carrier when the valve is in its frontmost position.

3. The percussive drilling tool of claim 1, wherein the valve further includes a rear support surface for engaging a front valve support surface on the probe carrier when the valve is in its rearmost position.

4. The percussive drilling tool of claim 1, wherein the valve further includes a biasing thrust area exposed to the high pressure flow coming from the source of pressurized fluid.

5. A percussive drilling tool comprising:

a cylindrical outer casing having a rear end and a front end;

a rear sub affixed to said rear end of the outer casing for connecting the percussive drilling tool to a source of pressurized fluid;

a drill bit mounted to said front end of the outer casing;

a piston slidably disposed inside said outer casing and capable of reciprocating due to a change in pressure of the pressurized fluid contained inside of a rear chamber and a front chamber located at opposites sides of the piston;

a cylinder disposed in between the outer casing and the piston; and a valve slidably mounted between a valve carrier and a probe carrier, the valve having a valve front thrust surface in communication with the rear chamber and a rear thrust surface in communication with a pressurized volume formed by surfaces of the probe carrier and the valve;

wherein said pressurized volume is isolated from high pressure flow coming from the source of pressurized fluid, and wherein the pressurized volume is in communication with the front chamber through at least one longitudinal passageway in the cylinder, the longitudinal passageway in the cylinder being open to the front chamber in its front end and being open to the pressurized volume in its rear end.

6. The percussive drilling tool of claim 5, wherein the valve further includes a front support surface for engaging a rear valve support surface on the valve carrier when the valve is in its frontmost position.

7. The percussive drilling tool of claim 5, wherein the valve further includes a rear support surface for engaging a front valve support surface on the probe carrier when the valve is in its rearmost position.

8. The percussive drilling tool of claim 5, wherein the valve further includes a biasing thrust area exposed to the high pressure flow coming from the source of pressurized fluid.

9. A percussive drilling tool comprising:

a cylindrical outer casing having a rear end and a front end;

a rear sub affixed to said rear end of the outer casing for connecting the percussive drilling tool to a source of pressurized fluid;

a drill bit mounted to said front end of the outer casing;

a piston slidably disposed inside said outer casing and capable of reciprocating due to a change in pressure of the pressurized fluid contained inside of a rear chamber and a front chamber located at opposites sides of the piston; and a valve slidably mounted between a valve carrier and a probe carrier, the valve having a valve front thrust surface in communication with the rear chamber and a rear thrust surface in communication with a pressurized volume formed by surfaces of the probe carrier and the valve;

wherein said pressurized volume is isolated from high pressure flow coming from the source of pressurized fluid, and wherein the pressurized volume is in communication with the front chamber through at least one longitudinal passageway in the outer casing, the longitudinal passageway in the outer casing being open to the front chamber in its front end and being open to the pressurized volume in its rear end.

10. The percussive drilling tool of claim 9, wherein the valve further includes a front support surface for engaging a rear valve support surface on the valve carrier when the valve is in its frontmost position.

11. The percussive drilling tool of claim 9, wherein the valve further includes a rear support surface for engaging a front valve support surface on the probe carrier when the valve is in its rearmost position.

12. The percussive drilling tool of claim 9, wherein the valve further includes a biasing thrust area exposed to the high pressure flow coming from the source of pressurized fluid.

* * * * *